US010399080B2

(12) United States Patent
Svensson et al.

(10) Patent No.: US 10,399,080 B2
(45) Date of Patent: Sep. 3, 2019

(54) MOVEABLE JAW MOUNTING ASSEMBLY

(71) Applicant: SANDVIK INTELLECTUAL PROPERTY AB, Sandviken (SE)

(72) Inventors: Johan Svensson, Malmo (SE); Marten Lindberg, Malmo (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 1040 days.

(21) Appl. No.: 14/759,925

(22) PCT Filed: Dec. 3, 2013

(86) PCT No.: PCT/EP2013/075379

§ 371 (c)(1),
(2) Date: Jul. 8, 2015

(87) PCT Pub. No.: WO2014/108251

PCT Pub. Date: Jul. 17, 2014

(65) Prior Publication Data

US 2015/0352555 A1 Dec. 10, 2015

(30) Foreign Application Priority Data

Jan. 9, 2013 (EP) ..... 13150629

(51) Int. Cl.

| | |
|---|---|
| ***B02C 1/00*** | (2006.01) |
| ***B02C 1/02*** | (2006.01) |
| ***B02C 1/06*** | (2006.01) |

(52) U.S. Cl.
CPC ..... *B02C 1/025* (2013.01); *B02C 1/02* (2013.01); *B02C 1/06* (2013.01)

(58) Field of Classification Search
CPC ..... B02C 1/025; B02C 1/02
See application file for complete search history.

(56) References Cited

U.S. PATENT DOCUMENTS

| | | | | |
|---|---|---|---|---|
| 3,473,744 | A | 10/1969 | Barber | |
| 4,637,562 | A | 1/1987 | Hagiwara et al. | |
| 4,765,546 | A * | 8/1988 | Stewart | B02C 1/005 241/266 |
| 4,783,013 | A | 11/1988 | Polzin | |
| 5,769,334 | A | 6/1998 | Nakayama et al. | |
| 5,799,888 | A | 9/1998 | Hamaguchi | |
| 6,375,105 | B1 | 4/2002 | Haven | |
| 7,143,970 | B2 | 12/2006 | Ha | |
| 7,344,097 | B2 * | 3/2008 | Young | B02C 1/025 241/268 |

(Continued)

FOREIGN PATENT DOCUMENTS

| | | | |
|---|---|---|---|
| CN | 2832296 | Y | 11/2006 |
| CN | 202238129 | U | 5/2012 |

(Continued)

*Primary Examiner* — Faye Francis
(74) *Attorney, Agent, or Firm* — Corinne R. Gorski

(57) ABSTRACT

A movable jaw mounting assembly to provide adjustment of the close side setting (CSS) of a movable jaw and to act as a retraction assembly or assist with retraction. The assembly includes a pair of linear actuators that are coupled between the back frame end and a region of the toggle unit so as to move the toggle unit towards and away from the back frame end to allow insertion and removal of spacers and/or shims.

14 Claims, 4 Drawing Sheets

(56) References Cited

U.S. PATENT DOCUMENTS

| | | | | |
|---|---|---|---|---|
| 7,510,134 | B2 * | 3/2009 | Young | B02C 1/025 241/268 |
| 7,513,446 | B2 * | 4/2009 | Young | B02C 1/025 241/101.3 |
| 2003/0132328 | A1 | 7/2003 | Musil | |
| 2004/0129814 | A1 | 7/2004 | Ha | |

FOREIGN PATENT DOCUMENTS

| | | | |
|---|---|---|---|
| DE | 2731664 | A1 | 3/1978 |
| FR | 2683462 | A1 | 5/1993 |
| GB | 1027520 | A | 4/1966 |
| GB | 1245791 | A | 9/1971 |
| JP | 60-251941 | A | 5/1987 |
| JP | H09956 | A | 1/1997 |
| JP | 2009297591 | A | 6/2008 |
| KR | 101018767 | B1 | 3/2011 |
| WO | 97/36683 | | 10/1997 |
| WO | 02/34393 | | 5/2002 |
| WO | 2008/010072 | | 1/2008 |

* cited by examiner

MOVEABLE JAW MOUNTING ASSEMBLY

RELATED APPLICATION DATA

This application is a § 371 National Stage Application of PCT International Application No. PCT/EP2013/075379 filed Dec. 3, 2013 claiming priority of EP Application No. 13150629.7, filed Jan. 9, 2013.

FIELD OF INVENTION

The present invention relates to a mounting assembly for a moveable jaw of a jaw crusher, and in particular although not exclusively, to a moveable jaw retraction assembly configured to displace a toggle unit formed from a force transmission wall to allow adjustment of a working separation distance between the moveable jaw and a stationary jaw.

BACKGROUND ART

Jaw crusher units typically comprise a fixed jaw and a movable jaw that together define a crushing zone. A drive mechanism is operative to rock the movable jaw back and forth in order to crush material in the crushing zone.

The crushing zone is generally convergent towards its lower discharge end so that crushable material fed to the upper and wider end of the zone is capable of falling downward under gravity whilst being subject to repeated cycles of crushing movement in response to the cyclical motion of the movable jaw. The crushed material is then discharged under gravity through the lower and narrower discharge end onto a conveyor belt for onward processing or discharge from the crusher unit to a suitable stock pile.

Commonly, the frame that supports the fixed jaw is referred to as the front frame end. The moveable jaw is connected to what is typically referred to as a back frame end via a mechanically actuated link mechanism that serves to control and stabilise the oscillating movement of the jaw relative to the stationary jaw. Typically, the link mechanism is both statically and dynamically linearly adjustable to control the grade or size of the resultant crushed material, to facilitate absorption of the impact forces generated by the crushing action and to expand or open the crushing zone to prevent damage to the crusher in the event of non-crushable material being accidentally introduced into the crushing zone.

Example jaw crushers comprising linkage assemblies connecting the back frame and front frame end are described in FR 2683462; EP 0773067; WO 97/36683; U.S. Pat. No. 5,799,888; WO 02/34393; WO 2008/010072, JP 2009-297591 EP 0148780, JP 60-251941, U.S. Pat. No. 7,143,970, CN 2832296, U.S. Pat. No. 6,375,105 and US 2003/0132328.

Jaw crushers of the types identified above typically include a retraction or tension assembly mounted at a lower region of the moveable jaw that is operative to apply pressure on the various components of the moveable jaw linkage positioned between the jaw and the back frame end. Additionally, conventional jaw crushers typically comprise an adjusting unit that controls the distance between the jaws. Example units include a shim package, a wedge system or a hydraulic toggle. This is useful to selectively adjust the jaw separation distance to either accommodate larger rocks within the crushing zone or allow passage of uncrushable material to exit the crusher and avoid damage. In some cases, a retraction assembly is used to mechanically separate the jaws.

Conventionally, one end of the retraction assembly attaches to a lower region of the moveable jaw with the other end mounted at an underside region of the back frame end. In some instances, a coil spring extends longitudinally from a hydraulic ram to provide an additional mounting linkage between the cylinder and the crusher frame. The coil spring is typically operative to limit the motion/extension resultant from the cyclical crushing movement of the moving jaw. The hydraulic ram is configured for adjustment of the position of the moving jaw when the jaw separation setting (close side setting (CSS)) is changed by the adjustment unit.

However, conventional retraction assemblies that either allow adjustment of the CSS or enable shim-setting modes include relatively complicated retraction actuator and hydraulic jack arrangements that perform separate functions. The conventional systems typically comprise many components and moving parts which accordingly increase the frequency for maintenance and the need to replace worn parts. What is required is a jaw mounting assembly configured to provide a simple, efficient and reliable mechanism for adjustment of the CSS and/or shim-setting.

SUMMARY OF THE INVENTION

It is an object of the present invention to provide a robust, reliable and simplified mounting assembly operative to enable convenient adjustment of the CSS and/or shim-setting. It is a further objective to minimise stress and load bearing concentrations on the mounting assembly components where possible.

The objectives are achieved, in part, by providing a mounting assembly comprising at least one linear actuator that is operative to displace a minimum number of components of the moveable jaw mounting assembly in order to allow adjustment of the CSS, shims or maintenance of the toggle unit. In particular, and in one specific implementation, a pair of linear hydraulic actuators is mounted at a support frame either side of a toggle unit. The actuators are operative to pull the toggle unit forward towards the stationary jaw to allow insertion/removal of CSS spacers and/or shims positioned between a region of the toggle unit and a part of the support frame typically referred to as the back frame end. The present assembly, due to its relative positioning, is also capable and configured to act as a retraction assembly (or assist with retraction) to control extension of the moveable jaw during its oscillating crushing motion so as to retain pressure on the toggle assembly component.

In one aspect the present invention is suitable for use with a hydraulic toggle unit in which one or a plurality of hydraulic cylinders extend between first and second ends of the toggle unit. Alternatively, the mounting assembly is also compatible with jaw mounting/support linkages that comprise non-hydraulic toggle plates.

According to a first aspect of the present invention there is provided a movable jaw mounting assembly to allow positional adjustment of a movable jaw of a jaw crusher relative to a stationary jaw, the assembly comprising: a load bearing support frame to couple at least part of the assembly to the jaw crusher, the support frame having a part with a force transmission wall configured to transmit impact loading forces from the moveable jaw to the support frame; a toggle unit positioned between the force transmission wall and the moveable jaw, the toggle unit having a first toggle end for attachment to the moveable jaw and a second toggle end for mounting in opposed relationship to the force transmission wall; at least one mechanical actuator to provide a pulling and/or pushing force; characterised in that: the mechanical actuator is attached at a first end to the support frame and at a second end to a part of the toggle unit so as to provide a pulling and/or pushing force to the toggle unit to change a separation distance between the second toggle end and the force transmission wall.

Reference within this specification to the mechanical actuator being 'attached' to the toggle unit encompass all manner of attachment including a floating joints where the two components may be separated, a unitary couple where the components are mechanically connected and cannot be immediately separated, abutment joints, and/or linkages via additional intermediate bodies.

Preferably, a longitudinal axis of the mechanical actuator is aligned substantially parallel to a longitudinal axis extending through the toggle unit. This alignment provides for maximum efficiency of the pulling and pushing force imparted by the actuator to the toggle unit as this force is aligned perpendicular to the force transmission wall and somewhat parallel with the crushing force.

Preferably, a force transmission pathway from the moveable jaw extends through the toggle unit and the force transmission wall but not through the mechanical actuator. That is, mechanical actuator is mounted at the support frame to be isolated from the force transmission pathway.

Preferably, the actuator is mounted at a side wall of the support frame laterally to one side of the toggle unit and attaches to the toggle unit via an aperture in the side wall. This is to be contrasted with the conventional mounting of retraction actuators that are typically positioned below the back frame end. Space at this region is limited and maintenance access is often problematic.

Preferably, the actuator is mounted to the toggle unit at a region of the second toggle end. More preferably the actuator is mounted to the toggle unit via a floating abutment connection between the back end toggle beam and a back end toggle plate. That is, the actuator is not coupled directly to the movable jaw and acts directly on the toggle unit. Due to the relative close proximity mounting of the actuator to the toggle unit, it is possible to use an actuator of compact and robust design. This is advantageous to assist with the overall weight reduction of the jaw crusher and to extend the actuator operational lifetime.

Preferably, a first end of the actuator is mounted at a side wall of the support frame laterally to one side of the toggle unit wherein the first end of the actuator is positioned closer to the moveable jaw relative to the second end of the actuator. Optionally, the cylinder end of the actuator is mounted laterally to one side of the toggle unit substantially at or towards the first toggle end whilst the rod end of the actuator is positioned laterally to one side of the toggle unit at or towards the second toggle end.

Preferably, the aperture in the side wall of the frame is elongate in a direction between the force transmission wall and the moveable jaw so as to allow a connection between the actuator and toggle unit to slide within the aperture.

Optionally, the assembly further comprises a plurality of spacers positioned between the force transmission wall and the second toggle end.

Optionally, the toggle unit comprises at least one hydraulic toggle actuator positioned between the first and second toggle ends. Optionally, the toggle unit comprises a single toggle plate extending between the first and second toggle ends (toggle seats).

Preferably, the mechanical actuator comprises a stroke length sufficient to move the movable jaw forward towards the fixed jaw to allow engagement of the mechanical lock.

Preferably, the assembly comprises two mechanical actuators mounted at respective side walls of the support frame laterally to either side of the toggle unit. Accordingly, the assembly preferably comprises two elongate apertures extending through the side walls, each aperture positioned laterally to one side of the toggle unit at a region of the second toggle end.

Preferably, each mechanical actuator is pivotally attached via a mounting to the second toggle end. The attachment of the cylinder rod to the toggle seat is achieved via alignment of the centre of the cylinder rod eye with the pivot line (longitudinal axis of the toggle seat). This concentric alignment minimises stress concentrations and accordingly extends the operational lifetime of the actuator.

Preferably, the mechanical actuator comprises a linear mechanical actuator comprising: a barrel having an internal chamber; a piston within the chamber and capable of reciprocating linear sliding movement within the chamber; a piston rod attached to the piston and capable of longitudinal reciprocating extension and retraction relative to the barrel, the rod having a first end positioned furthest from the barrel; wherein the barrel is attached to the support frame and the rod is attached to a region of the second toggle end.

According to a second aspect of the present invention there is provided a jaw crusher comprising an assembly as described herein.

Preferably, the crusher further comprises a mechanical lock to fix the moveable jaw in immobile position relative to the stationary jaw. Preferably, the mechanical lock comprises a latch, rod, bolt or sprint positioned to extend between the side wall(s) of the crusher and the moveable jaw so as to lock the jaw relative to the side wall(s).

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
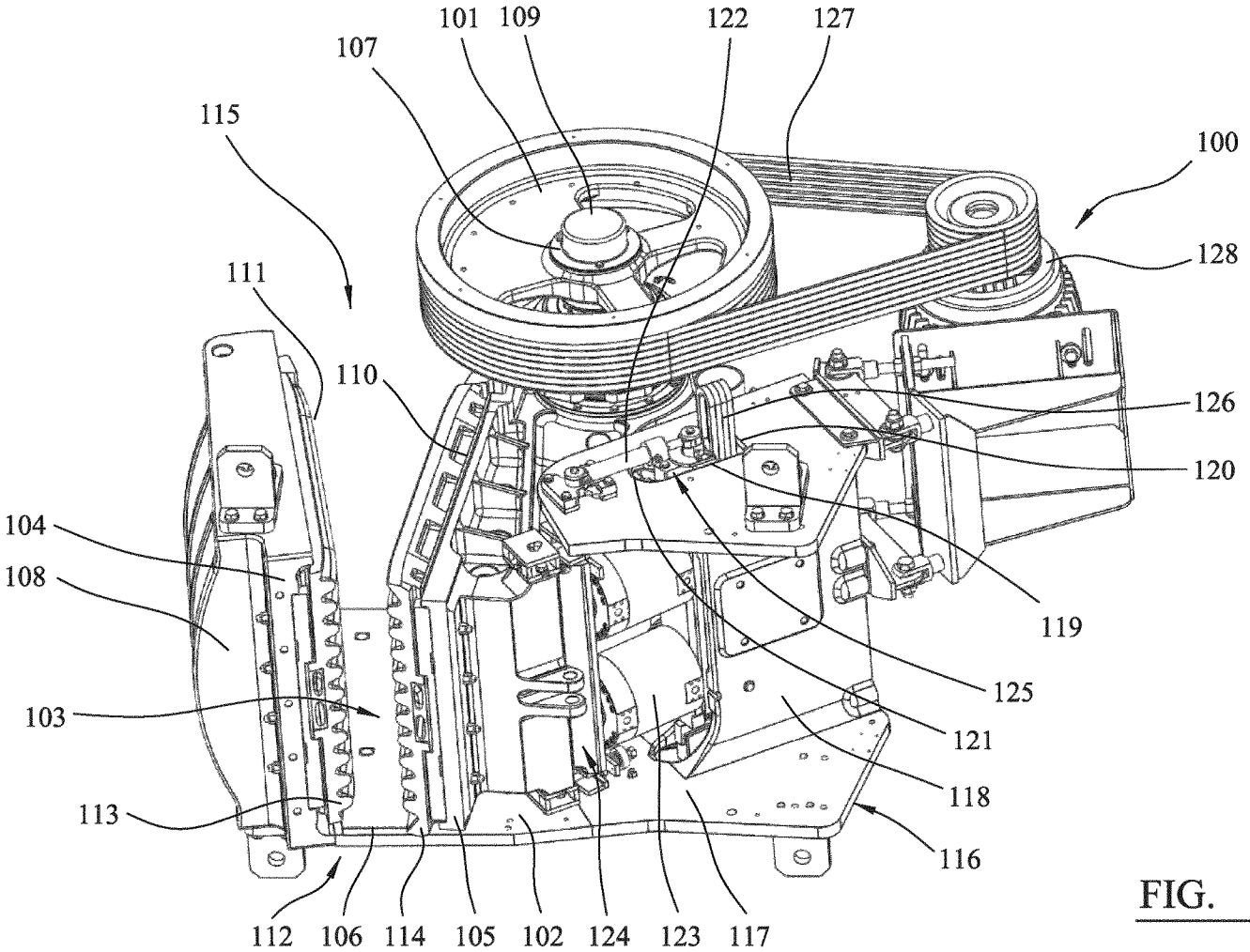
FIG. 1 is an underside perspective view of a jaw crusher comprising a moveable jaw mounting assembly according to a specific implementation of the present invention.

Referring to FIG. 1, a jaw crusher 100 comprises a main frame 102 upon which is mounted a moveable jaw 105 and a substantially fixed jaw 104. The movable jaw 105 is mounted eccentrically at a rotatable shaft 107 (extending from underneath an end cap 109) and is positioned separated and opposed to fixed jaw 104. The orientation of fixed jaw 104 and movable jaw 105 relative to one another is convergent along their respective lengths such that a separation distance between a crushing face 111 of fixed jaw 104 and a corresponding crushing face 110 of movable jaw 105 decreases in the downward lengthwise direction. A suitable wear plate 113 is removably attached to crushing face 111 of fixed jaw 104 and a corresponding wear plate 114 is removably attached to crushing face 110 of movable jaw 105. Main frame 102 comprises two opposed frame walls that support the front frame end 108, which is aligned substantially perpendicular to frame walls 102. The side walls extend either side of fixed jaw 104 and movable jaw 105 to collectively define a crushing zone 103.

The opposed fixed 104 and movable 105 jaws are oriented to be inclined relative to one another and are spaced apart further at their respective upper ends than their lower ends. Accordingly, the crushing zone 103 is convergent from an upper feed region 115 to a lower discharge region 112.

A pair of fly wheels 101 are mounted either end of shaft 107 at an external facing side of side frame walls 102 being external to the crushing zone 103. Movable jaw 105 is thereby configured for gyroscopic or eccentric motion with respect of fixed jaw 104 as fly wheels 101 and shaft 107 are rotated via mating between v-belt grooves at the fly wheels 101 end a suitable drive belt 127 which in turn is attached to a drive motor 128. This movement of jaw 105 provides the necessary crushing action for material within zone 103 between the opposed wear plates 113 and 114. A plurality of removably mounted side liners 106 are attached to each side frame wall 102 at the region of crushing zone 103.

Movable jaw 105 is supported by a back frame end 116. In particular, back frame end 116 provides a mount for a mechanically actuated linkage that is coupled to a lower region of movable jaw 105 so as to support and stabilise the oscillating movement of jaw 105. The linkage comprises a hydraulic toggle assembly having ends 124 and 125 with end 124 coupled to movable jaw 105. A second end 125 of the toggle unit is positioned at the back frame end 116 such that the force transmission pathway, during crushing operations, progresses from movable jaw 105 through toggle unit and into back frame end 116. Accordingly, the toggle unit acts as a connecting member between the rear support frame 116 and movable jaw 105 such that jaw 105 is retained in floating manner with respect to stationary jaw 105.

Figure 2:
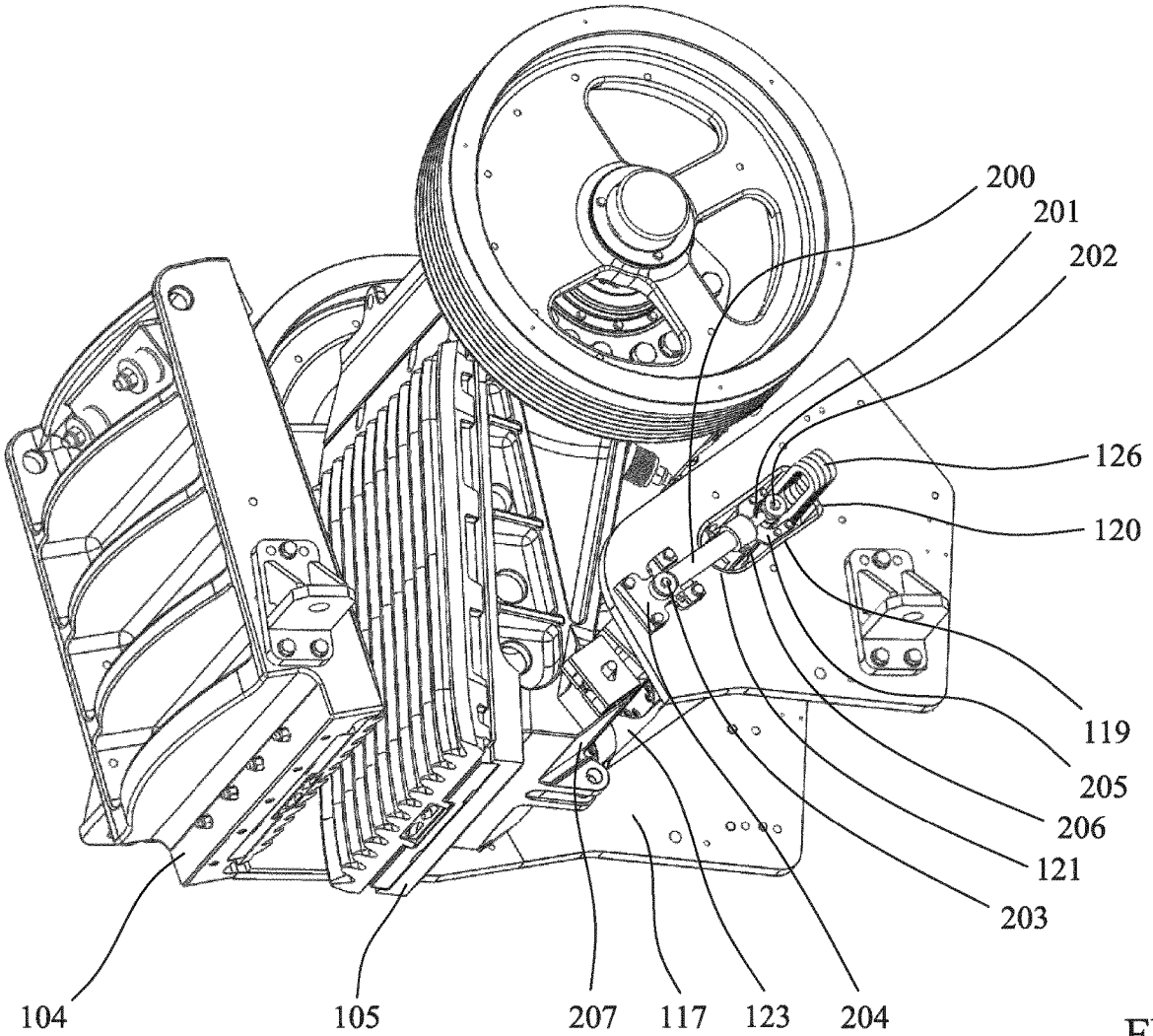
FIG. 2 is a further lower perspective view of the jaw crusher of FIG. 1 with further components removed for clarity.

Referring to FIGS. 1 to 4, the mounting assembly for the movable jaw 105 further comprises a pair of retraction actuators 122 positioned laterally either side of toggle unit. Referring to FIG. 2, each actuator comprises a main cylinder 200 housing a piston (not shown). An actuator rod 201 is capable of linear extension and retraction relative to cylinder 200 according to conventional linear actuator configurations. Cylinder 200 is terminated at one end by a pivot mounting 203 connected to a base mount 204. Mount 204 is in turn attached to an external side surface of a region of back frame end 116. A second end of actuator 122 is mounted at an end region 125 of the toggle unit. In particular, rod 201 terminates at a mounting eye that forms a part of a pivot mounting 202 that is coupled to a toggle beam (seat) 206 that extends laterally through a region of the back frame end 116 between the frame side walls. Accordingly, each rod 201 of the pair of actuators 122 is connected to each end of toggle beam 206 via a toggle holder in the form of a part cylindrical extension (not shown) that is physically connected to a back end toggle plate 303. The toggle holder is configured to abut against a C-shaped flange 205 that is attached securely at each end of the beam 206. Accordingly, this connection between actuators 122 and the beam 206 is floating such that the beam 206 is rendered 'free' relative to the toggle holder and hence toggle plate 303.

Figure 3:
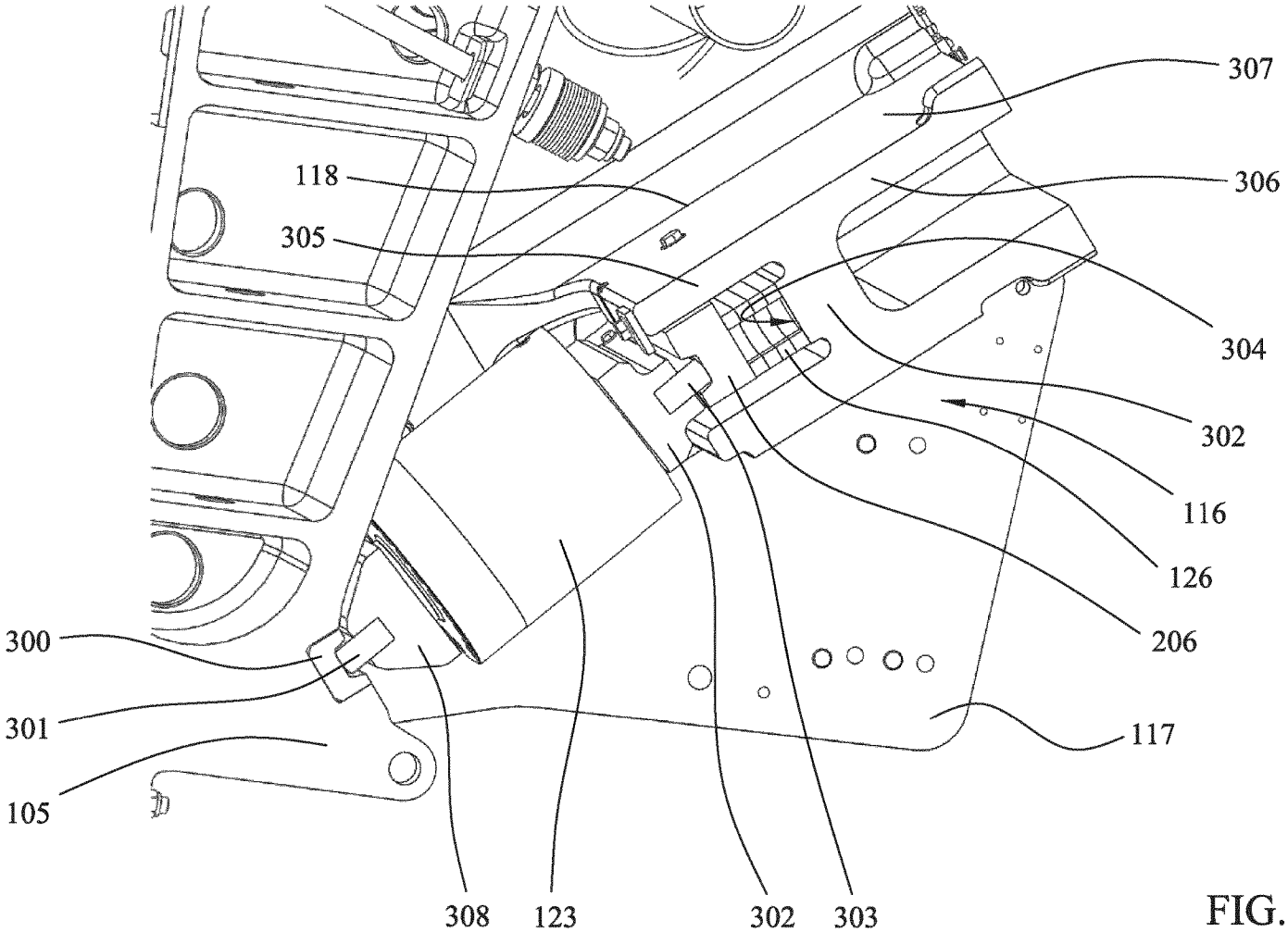
FIG. 3 is a partial cross section perspective view through the back frame end and jaw mounting assembly of FIG. 2.

FIG. 3 illustrates selected components of the back frame end and toggle unit with various components removed for image clarity. Back frame end 116 comprises a pair of side walls 117. Side walls 117 are mounted either side of a laterally extending beam 118 having a generally H-shaped cross sectional profile as illustrated in FIG. 3. In particular, a force transmission wall 302 provides a bridge to connect a pair of parallel plate like bodies 307. Accordingly, wall 302 divides each plate like body 307 into a first pair of opposed plate like flanges 305 orientated towards movable jaw 105 and a second pair of plate like flanges 306 orientated rearwardly away from movable jaw 105. Force transmission wall 302 comprises an abutment face 304 positioned between front flanges 305. A channel-like cavity is created between flanges 305 and accommodates a plurality of plate-like spacers 126 that seat against face 304.

The toggle unit may be considered to comprise the back end toggle beam (seat) 206; the back end toggle plate 303, a back end hydraulic mounting bar 302; at least one hydraulic cylinder 123; a front end hydraulic mounting bar 308; a front end toggle plate 301; and a front end toggle beam (seat) 300.

Figure 4:
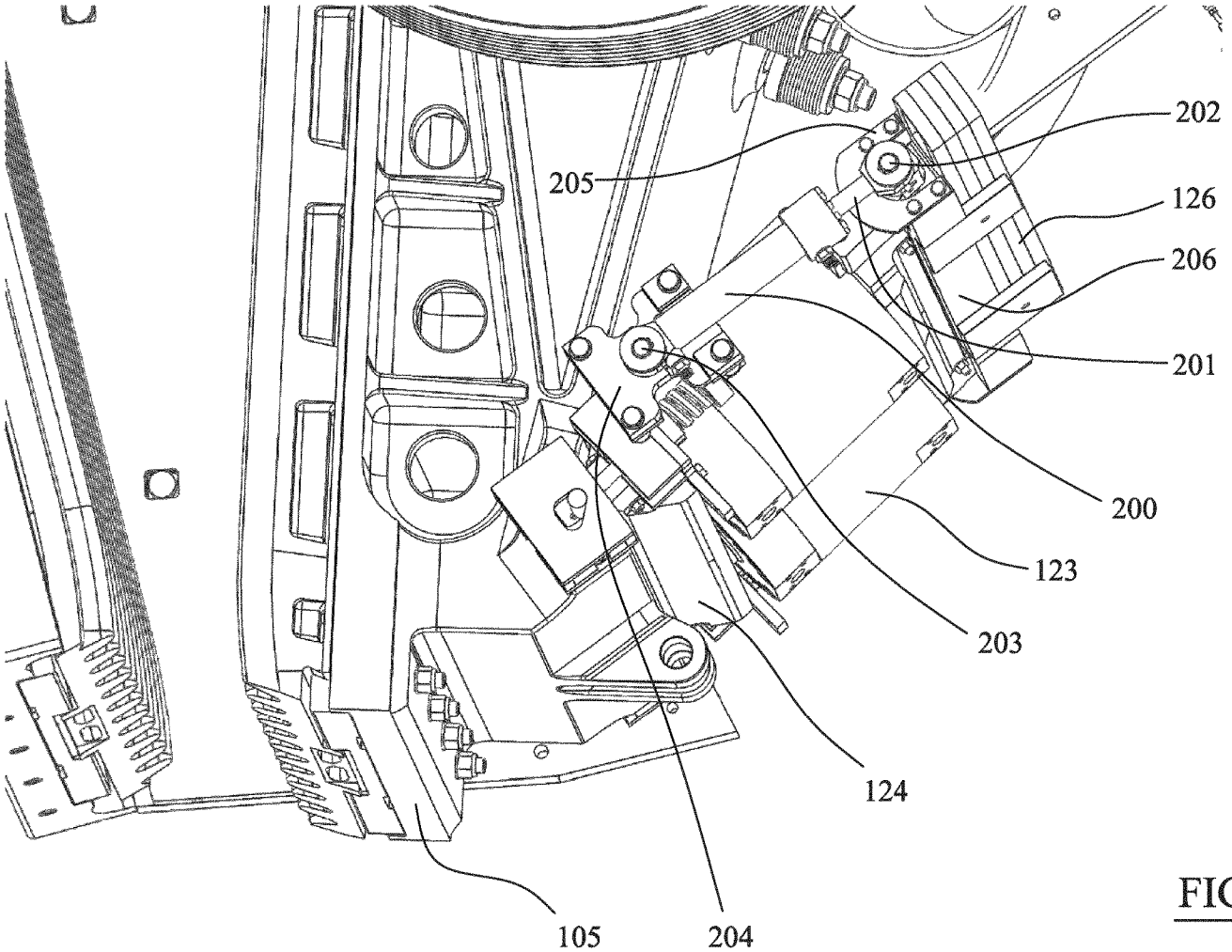
FIG. 4 is a perspective view of the crusher of FIG. 2 with the back frame end removed for image clarity to illustrate selected components of the moveable jaw mounting assembly.

The toggle beam 206 extends between flanges 305. The toggle beam 206 extends between flanges 305 to abut spacers 126 which are in turn journalled against face 304. Beam 206 acts as a toggle seat and forms one end (125) of the toggle unit. The second toggle end plate 303 abuts an opposed end of beam 206 and is in turn coupled to the generally wedge shaped hydraulic mounting bar 302. Components 302, 306, 206 (and optionally their various mountings) may be considered to comprise the second end 125 of the toggle unit mounted at back frame end 116. An opposite first end 124 of the toggle unit is orientated for mounting against movable jaw 105. The first toggle end 124 may be considered to comprise the generally wedge shaped hydraulic mounting bar 308 that connects hydraulic cylinders 123 to the first toggle end plate 301, plate 301 and toggle beam 300. In particular, Plate 301 is mounted at movable jaw 105 via the toggle beam (seat) 300. As illustrated in FIGS. 1 and 4, the hydraulic toggle unit comprises a pair of hydraulic cylinders 123 mounted side-by-side and extending between first toggle end plate 301 and second toggle end plate 303 mounted at movable jaw 105 and back frame end 116, respectively.

As illustrated in FIGS. 1 and 2, the actuators 122 are mechanically anchored at the back frame end 116 via mounting upon respective external facing surfaces of side walls 117. Each actuator 122 is aligned substantially parallel with the plate like flanges 307 of the back frame end 116 and the general alignment of the toggle unit. Accordingly, cylinder mounting end 203 is positioned closest to movable jaw 105 relative to rod mounting end 202.

Each side wall 117 comprises an elongate aperture 119 having a first end 121 and a second end 120. Each aperture 117 is positioned so as to expose (through side wall 117) the end regions of toggle beam 206 (and the C-shaped brackets 205). Accordingly, each actuator 122 contacts approximately at toggle beam 206 via the mountings 202, 205 that pass at least partially through aperture 119. As aperture 119 is elongate, each actuator 122 is operative to push and pull toggle seat 206 in a direction towards and away from force transmission wall 302 via extension and retraction of rod 201 relative to cylinder 200. Each actuator 122 is controlled by a suitable electronic control (not shown) and an appropriate hydraulic fluid circuit including a fluid reservoir (not shown).

Each actuator 122 accordingly provides a linear mechanical linkage between the side walls 117 of back frame end 116 and one end of the toggle unit corresponding to toggle beam 206 (via mountings 202, 205). By extending and retracting rod 201 relative to cylinder 200, toggle seat 206 is moved relative to wall 302 to adjust the separation distance between face 304 and toggle seat 206. Accordingly, where it is required to adjust the CSS, toggle beam 206 is moved away from surface 304 to increase the separation distance and allow additional spacers 126 to be inserted. Each rod 201 is then extended to trap spacers 126 in position between toggle seat 206 and face 304. Accordingly, actuators 122 are operative over very short distances and are isolated from the force transmission pathway extending from movable jaw 105 to back frame end 116. This is advantageous to reduce component wear and to provide an efficient and robust jaw mounting arrangement.

If toggle unit (or a further component of the jaw mounting assembly) requires maintenance, actuators 122 may be operated to fully retract rod 201 into cylinder 200 to move jaw 105 to a minimum separation distance relative to jaw 104. A mechanical lock (not shown) is then configured to lock jaw 105 in stationary position. The actuators 122 can then be mechanically released to allow separation of the components of the toggle assembly. As will be appreciated, the hydraulic toggle cylinders 123 may be engaged to assist or provide the linear actuation for adjustment of the CSS in addition to the above maintenance positioning.

According to a further specific embodiment, jaw crusher 100 may comprise a non-hydraulic toggle unit in which hydraulic cylinders 123 are replaced by a conventional single plate-like toggle extending between toggle seats 206 and 300 referring to FIG. 3.

The invention claimed is:

1. A movable jaw mounting assembly arranged to provide retraction and positional adjustment of a movable jaw of a jaw crusher relative to a stationary jaw, the jaw mounting assembly comprising:

a load bearing support frame having a part with a force transmission wall configured to transmit impact loading forces associated with the moveable jaw to the support frame;

a toggle unit having a first toggle end associated with the moveable jaw, a second toggle end mounted, in opposed relationship, to the force transmission wall, a toggle beam forming the second toggle end, and a toggle plate positioned between the first toggle end and the second toggle end;

at least one mechanical actuator arranged to provide a pulling and/or pushing force, the mechanical actuator being attached at a first end to the support frame and at a second end of the toggle unit so as to provide a pulling and/or pushing force to the toggle unit to change a separation distance between the second toggle end and the force transmission wall;

a toggle holder connecting the second end of the at least one actuator to the toggle plate such that the toggle plate and the toggle beam are arranged to move towards the force transmission wall by the at least one actuator to retain pressure on the toggle unit during retraction; and a mounting bracket attached to the toggle beam and arranged to abut the toggle holder when the actuator is operative to move the toggle beam away from the force transmission wall during adjustment.

2. The assembly as claimed in claim 1, wherein a force transmission pathway extends through the toggle unit and the force transmission wall, but not through the at least one mechanical actuator.

3. The assembly as claimed in claim 1, wherein the actuator is mounted at a side wall of the support frame laterally to one side of the toggle unit and attaches to the toggle unit via an aperture in the side wall.

4. The assembly as claimed in claim 3, wherein the aperture in the side wall of the frame is elongate in a direction between the force transmission wall and the moveable jaw so as to allow a connection between the actuator and toggle unit to slide within the aperture.

5. The assembly as claimed in claim 1, wherein a first end of the at least one mechanical actuator is mounted at a side wall of the support frame laterally to one side of the toggle unit, and wherein the first end of the at least one mechanical actuator is positioned closer to the moveable jaw than a second end of the actuator.

6. The assembly as claimed in claim 1, further comprising a plurality of spacers positioned between the force transmission wall and the second toggle end.

7. The assembly as claimed in claim 1, wherein the toggle unit includes at least one hydraulic toggle actuator positioned between the first and second toggle ends.

8. The assembly as claimed in claim 1, wherein the toggle unit includes a single toggle plate extending between the first and second toggle ends.

9. The assembly as claimed in claim 1, further comprising two mechanical actuators mounted at respective side walls of the support frame laterally to either side of the toggle unit.

10. The assembly as claimed in claim 9, further comprising two elongate apertures extending through the side walls, each aperture being positioned laterally to one side of the toggle unit at a region of the second toggle end.

11. The assembly as claimed in claim 10, wherein each of the mechanical actuators is pivotally attached via a mounting to the second toggle end.

12. The assembly as claimed in claim 1, wherein the at least one mechanical actuator includes a linear mechanical actuator including:

a barrel having an internal chamber;

a piston within the chamber and arranged for reciprocating linear sliding movement within the chamber; and a piston rod attached to the piston and arranged for longitudinal reciprocating extension and retraction relative to the barrel, the rod having a first end positioned furthest from the barrel, wherein the barrel is attached to the support frame and the rod is connected to the toggle plate via the toggle holder.

13. A jaw crusher comprising:

a movable jaw;

a stationary jaw; and a movable jaw mounting assembly arranged to provide retraction and positional adjustment of the movable jaw relative to the stationary jaw, the jaw mounting assembly including a load bearing support frame arranged to couple at least part of the assembly to the jaw crusher, the support frame having a part with a force transmission wall configured to transmit impact loading forces from the moveable jaw to the support frame, a toggle unit positioned between the force transmission wall and the moveable jaw, the toggle unit having a first toggle end arranged for attachment to the moveable jaw and a second toggle end for mounting in opposed relationship to the force transmission wall, a toggle beam forming the second toggle end, and a toggle plate positioned between the first toggle end and the second toggle end, at least one mechanical actuator arranged to provide a pulling and/or pushing force, the mechanical actuator being attached at a first end to the support frame and at a second end of the toggle unit so as to provide a pulling and/or pushing force to the toggle unit to change a separation distance between the second toggle end and the force transmission wall, a toggle holder connecting the second end of the at least one actuator to the toggle plate such that the toggle plate and the toggle beam are arranged to move towards the force transmission wall by the at least one actuator to retain pressure on the toggle unit during retraction, and a mounting bracket attached to the toggle beam arranged to abut the toggle holder when the actuator is operative to move the toggle plate away from the force transmission wall during adjustment.

14. The assembly as claimed in claim 13, further comprising a mechanical lock arranged to fix the moveable jaw in an immobile position relative to the stationary jaw.

* * * * *